US007650666B2

(12) United States Patent
Jang

(10) Patent No.: US 7,650,666 B2
(45) Date of Patent: Jan. 26, 2010

(54) ROBOT CLEANER

(75) Inventor: Seung-Rak Jang, Seoul (KR)

(73) Assignee: Kyungmin Mechatronics Co., Ltd., Cheonan, Chungnam (KR)

( * ) Notice: Subject to any disclaimer, the term of this patent is extended or adjusted under 35 U.S.C. 154(b) by 0 days.

(21) Appl. No.: 12/158,229

(22) PCT Filed: Sep. 4, 2006

(86) PCT No.: PCT/KR2006/003493

§ 371 (c)(1),
(2), (4) Date: Jun. 19, 2008

(87) PCT Pub. No.: WO2007/073029

PCT Pub. Date: Jun. 28, 2007

(65) Prior Publication Data

US 2008/0271278 A1 Nov. 6, 2008

(30) Foreign Application Priority Data

Dec. 22, 2005 (KR) ..... 10-2005-0127949

(51) Int. Cl.
*A47L 9/00* (2006.01)

(52) U.S. Cl. ..... 15/319; 15/340.1; 15/340.3

(58) Field of Classification Search ..... 15/319, 15/340.1, 340.3; *A47L 9/00, 9/02*
See application file for complete search history.

(56) References Cited

U.S. PATENT DOCUMENTS 7,246,405 B2 * 7/2007 Yan ..... 15/340.1

FOREIGN PATENT DOCUMENTS

| | | |
|---|---|---|
| JP | 2005-211362 | 8/2005 |
| KR | 20-2000-0000978 | 1/2000 |
| KR | 1020040003444 | 1/2004 |
| KR | 1020050108556 | 11/2005 |

* cited by examiner

*Primary Examiner*—David A Redding
(74) *Attorney, Agent, or Firm*—IPLA P.A.; James E. Bame

(57) ABSTRACT

A robot cleaner is mainly comprised of a base case whose upper portion is equipped with a driving part for running and a suction part for removing dust or dirt; and a top case covering on top of said base case, wherein said base case is formed at lower portion thereof with an inside vertical wall protruding so as to surround dust suction aperture, and with an outside vertical wall external to said inside vertical wall so that a hollow part may be formed in-between surrounding said inside vertical wall; and an auxiliary suction wall is installed between said inside vertical wall and outside vertical wall in such a manner that said auxiliary suction wall is movable by force of spring external to said inside vertical wall between a No. 1 position locating toward floor (F) and a No. 2 position locating withdrawn from said No. 1 position opposite to floor (F), said auxiliary suction wall being positioned toward floor (F) when no external forces are applied. According to this configuration, it is easy and convenient to install the auxiliary suction wall around dust suction inlet for enhancing easiness in dust suction.

2 Claims, 3 Drawing Sheets

ROBOT CLEANER

TECHNICAL FIELD

The present invention relates generally to a robot cleaner, and more particularly to a robot cleaner which is furnished with an auxiliary suction wall installed around dust suction inlet for enhancing easiness in suction of dust.

BACKGROUND ART

Robot cleaner in general is an automatic cleaner for cleaning a certain area automatically by running itself around the area, removing dust or dirt out of floor without user's direct manipulation.

In such robot cleaner as described above, a dust suction inlet is set inserted at dust suction aperture formed at one side of the base case thereof, and a variety of dust or dirt scattered on floor can be sucked by this dust suction inlet into a dust box formed within the robot cleaner.

As for said dust suction inlet, if the opening thereof were formed big so as to suck dust easily through said dust suction inlet, sucking power thereof would rather become weak. This is the reason why the opening thereof is generally formed small. However, with an opening of dust suction inlet formed small, it will need longer time and more cost for dust or dirt scattered on floor to be inhaled through such dust suction inlet. Therefore, in order to solve the problem involved in a small opening of dust suction inlet at the same time with considering savings of time and cost, additional auxiliary means will be necessary for enhancing easiness in suction of dust.

DISCLOSURE OF THE INVENTION

Technical Problem

The present invention was contrived to alleviate or solve above-mentioned problems and/or drawbacks. It is an object of the present invention therefore to provide a robot cleaner which is furnished with an auxiliary suction wall installed around dust suction inlet for enhancing easiness in suction of dust.

It is another object of the present invention to provide a robot cleaner of which auxiliary suction wall for enhancing easiness in suction of dust is formed in a simple configuration, thereby fabrication cost and assembling cost of the auxiliary suction wall is reduced.

Technical Solution

The robot cleaner according to the present invention in order to achieve the objects described as above is a robot cleaner capable of running around by itself on a prescribed path for removing dust or dirt out of floor, the robot cleaner being furnished with a base case whose upper portion is equipped with a driving part for running and a suction part for removing dust or dirt and one side is formed with a dust suction aperture to which a dust suction inlet is inserted for inhaling dust or dirt from floor into said suction part; and with a top case covering on top of said base case, wherein said base case is formed at lower portion thereof with an inside vertical wall protruding so as to surround said dust suction aperture, and with an outside vertical wall external to said inside vertical wall so that a hollow part may be formed in-between surrounding said inside vertical wall; and an auxiliary suction wall is installed between said inside vertical wall and outside vertical wall in such a manner that said auxiliary suction wall is movable by force of spring external to said inside vertical wall between a No. 1 position locating toward floor and a No. 2 position locating withdrawn from said No. 1 position opposite to floor, said auxiliary suction wall being positioned toward floor when no external forces are applied.

Said auxiliary suction wall is preferably formed along periphery thereof with a plurality of catching prominences that are supportable by insertion at the base case, and at both sides thereof with guide rods protruding, wherein said guide rod each is inserted by a spring capable of applying force in such a direction that said auxiliary suction wall should get far from said base case.

Said auxiliary suction wall is preferably further formed at the side thereof touching on floor (F), with a flange for increasing contact area with floor.

Advantageous Effect

In robot cleaner according to the present invention, an auxiliary suction wall for enhancing easiness in suction of dust can be formed external to dust suction inlet in a simple configuration; the auxiliary suction wall formed in this way can be easily assembled in base case, thereby fabrication cost of robot cleaner can be lowered.

BEST MODE FOR CARRYING OUT THE INVENTION

Hereinafter, a robot cleaner according to preferred embodiment of the present invention will be described in detail with reference to appended drawings.

Referring to FIGS. 1 to 4, a robot cleaner according to the present invention, furnished with a base case 10 and a top case 20 covering on top of said base case 10 can run by itself along a prescribed path, removing dust or dirt scattered on floor.

Said base case 10 is equipped at upper portion thereof with a driving part (not shown in Figures) for running and a suction part (not shown) for removing dust or dirt, and is formed at one side thereof with a dust suction aperture 11 to which a dust suction inlet 18 is inserted for inhaling dust or dirt from floor (F) into said suction part.

Detailed configurations of said driving part and suction part are not different so much and are generalized for conventional robot cleaners; those skilled in the art can easily fabricate various types of such configurations, thus detailed explanations thereof are not described in this specification.

Figure 1:
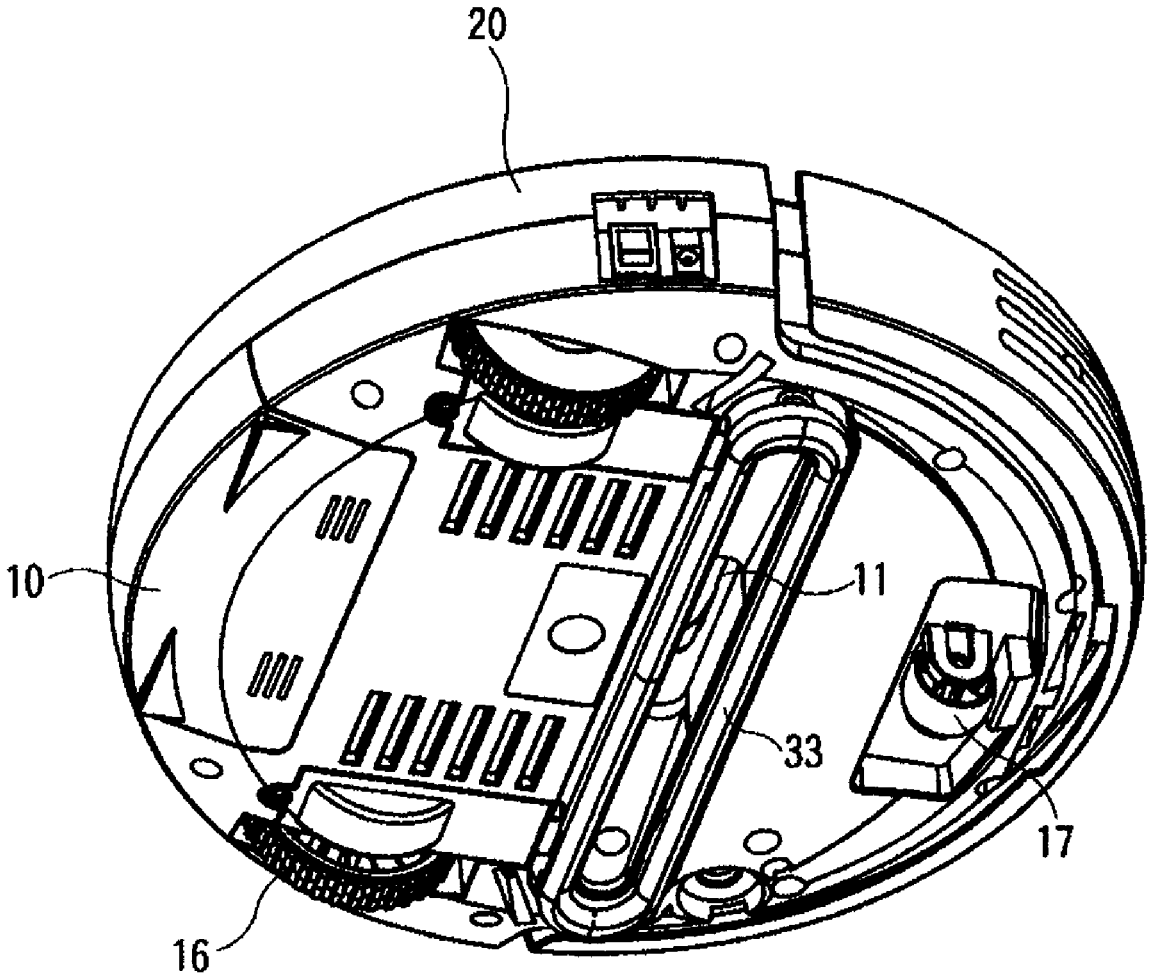
FIG. 1 is perspective view of a robot cleaner according to the present invention.
Figure 2:
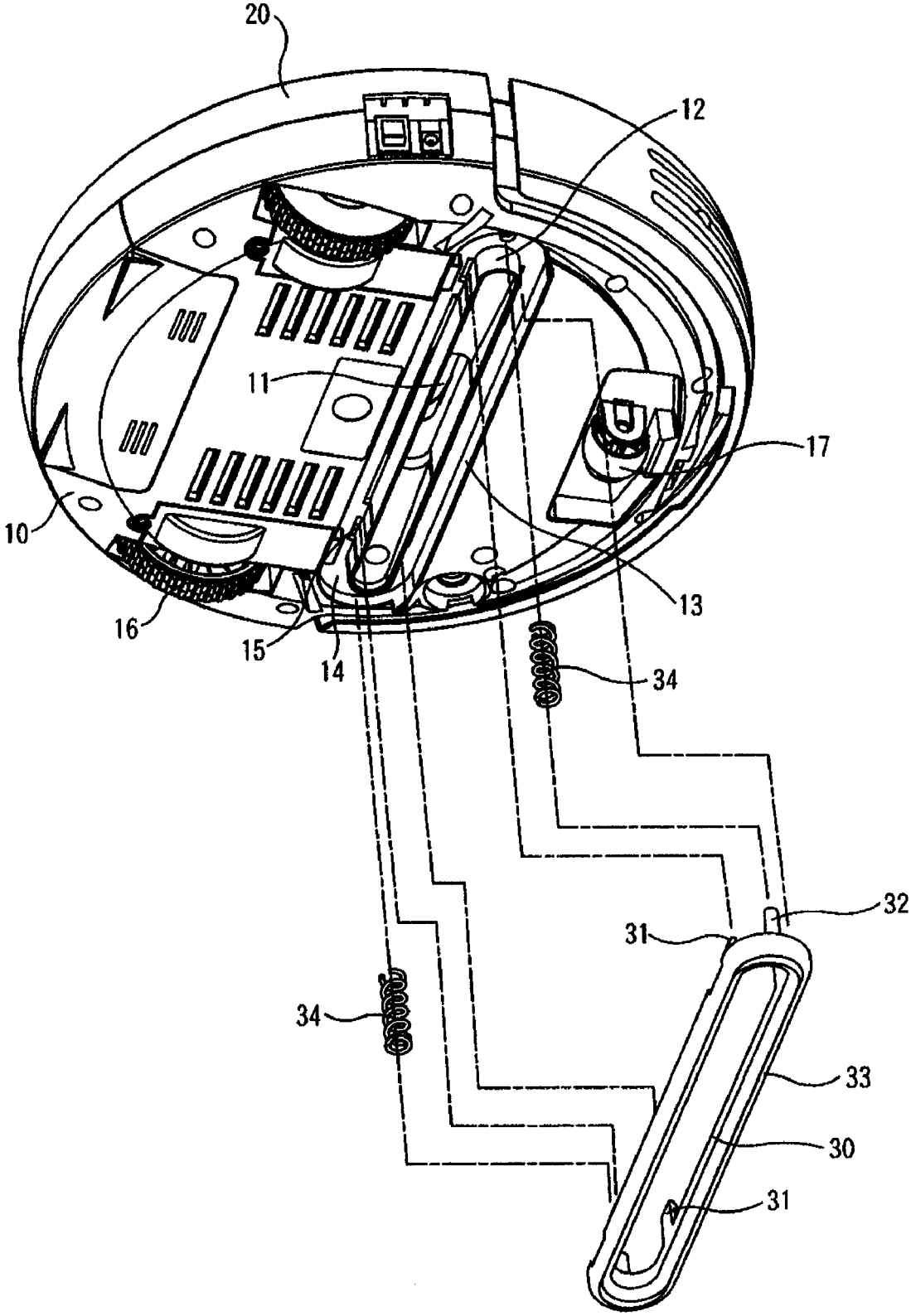
FIG. 2 is exploded perspective view showing auxiliary suction wall in separation from a robot cleaner according to the present invention.

Referring to FIG. 2, said base case 10 is formed at lower portion thereof with an inside vertical wall 12 protruding so as to surround said dust suction aperture 11, and with an outside vertical wall 13 external to said inside vertical wall 12 so that a hollow part 14 may be formed in-between surrounding said inside vertical wall 12.

An auxiliary suction wall 30 is installed between said inside vertical wall 12 and outside vertical wall 13 in such a manner that said auxiliary suction wall 30 is movable by force of spring 34 external to said inside vertical wall 12 between a No. 1 position locating toward floor (F) and a No. 2 position locating withdrawn from said No. 1 position opposite to floor (F), said auxiliary suction wall 30 being positioned toward floor (F) when no external forces are applied.

Figure 3:
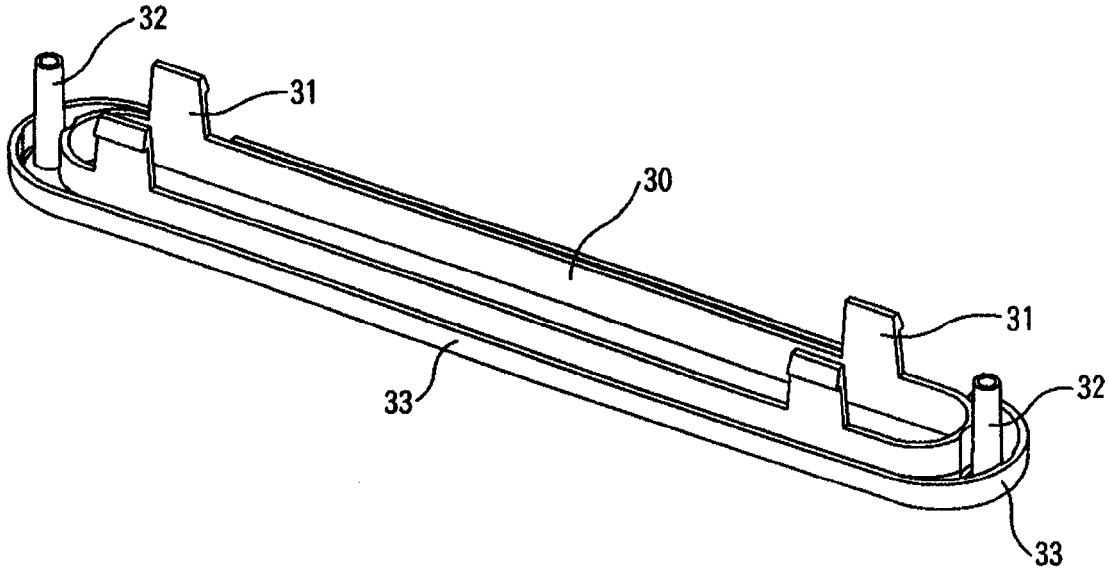
FIG. 3 is external perspective view of auxiliary suction wall in a robot cleaner according to the present invention.

Referring to FIG. 3, said auxiliary suction wall 30 is formed along periphery thereof with a plurality of catching prominences 31 that are supportable by insertion at the base case 10, and at both sides thereof with guide rods 32 protruding, wherein said guide rod 32 each is inserted by a spring 34 capable of applying force in such a direction that said auxiliary suction wall 30 should get far from said base case 10.

Moreover, said auxiliary suction wall 30 is further formed at the side thereof touching on floor (F), with a flange 33 for increasing contact area with floor (F). Unexplained number 16 stands for driving wheel, and number 17 for driven wheel.

Figure 4:
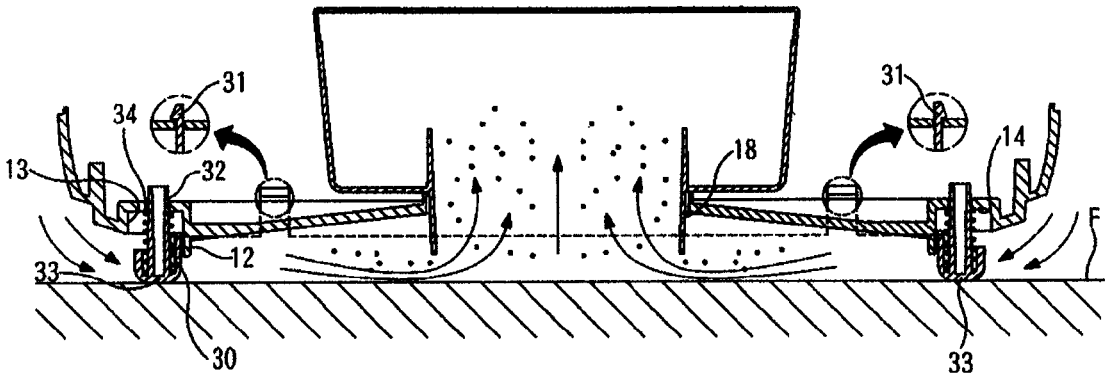
FIG. 4 is sectional view for describing the function of a robot cleaner according to the present invention.

The robot cleaner of the present invention having above-said configuration runs along prescribed path by itself sucking and inhaling various types of dust or dirt scattered on floor (F) according to vacuum suction method as shown in FIG. 4 through a dust suction inlet 18 inserted at the dust suction aperture 11 formed at one side of base case 10 into a dust box located within the robot cleaner.

At this time, dust suction inlet 18 set inserted at dust suction aperture 11 formed at base case 10 of robot cleaner generally has its opening formed small. Therefore in order to enhance easiness in suction of dust, the auxiliary suction wall 30 installed around said dust suction aperture 11 has much larger dimension than said dust suction aperture 11.

Accordingly, in order to install said auxiliary suction wall 30 at the base case 10 of robot cleaner, the inside vertical wall 12 and outside vertical wall 13 are formed along periphery of dust suction aperture 11 in such a manner that a hollow part 14 is formed between said inside vertical wall 12 and outside vertical wall 13, and then an auxiliary suction wall 30 is installed in said hollow part 14 with intervention of spring 34.

Said auxiliary suction wall 30 can be installed in a simple way at base case 10. The procedure for installation of said auxiliary suction wall 30 in said hollow part 14 formed between said inside vertical wall 12 and outside vertical wall 13 is as follows: With the spring 34 each being kept inserted at guide rod 32 each of auxiliary suction wall 30, the catching prominences 31 of auxiliary suction wall 30 are let face toward base case 10, then inserted into apertures 15 formed at base case 10. When no external forces are applied thereon, said auxiliary suction wall 30 has its position toward floor (F) by virtue of spring 34 in such a direction that said auxiliary suction wall 30 should get far from said base case 10. Therefore, the flange 33 formed at lower part of said auxiliary suction wall 30 to the side touching on floor (F) is positioned always in contact with floor (F) by virtue of spring 34. Under such position, when a blowing motor (not shown in Figures) operates for suction part formed in robot cleaner, various types of dust or dirt scattered on floor (F) are inhaled through dust suction inlet 18 into dust box. At this time, because of the auxiliary suction wall 30 maintaining close contact with floor (F) by virtue of spring 34 so as to play a kind of role of sheltering curtain, the pressure inside said auxiliary suction wall 30 gets close to vacuum differently from ambient pressure outside.

Accordingly, the pressure close to vacuum set inside said auxiliary suction wall 30 enables easier inhalation of dust or dirt placed within said auxiliary suction wall 30 through dust suction inlet 18 into dust box located within robot cleaner.

The present invention has been described hereinbefore according to preferred embodiments illustrated in appended drawings, which are however explanatory examples; it will be apparent to those who have common knowledge in the art that various modifications, variations and equivalent embodiments can be made without departing from the technical concepts of the invention. Therefore, such kind of equivalent embodiments should also be deemed to be inclusive within the scope of patented right to be claimed according to the present invention.

INDUSTRIAL APPLICABILITY

As has been described hereinbefore, in the robot cleaner according to the present invention, an auxiliary suction wall 30 for enhancing easiness in dust suction can be formed with a simple configuration external to dust suction inlet 18; such auxiliary suction wall 30 formed with a simple configuration can be easily assembled in base case 10, thereby the fabrication cost of robot cleaner can be lowered.

What is claimed is:

1. A robot cleaner capable of running around by itself on a prescribed path for removing dust or dirt out of floor, the robot cleaner being furnished with a base case whose upper portion is equipped with a driving part for running and a suction part for removing dust or dirt and one side is formed with a dust suction aperture to which a dust suction inlet is inserted for inhaling dust or dirt from floor into said suction part; and with a top case covering on top of said base case, wherein said base case is formed at lower portion thereof with an inside vertical wall protruding so as to surround said dust suction aperture, and with an outside vertical wall external to said inside vertical wall so that a hollow part may be formed in-between surrounding said inside vertical wall; and an auxiliary suction wall is installed between said inside vertical wall and outside vertical wall in such a manner that said auxiliary suction wall is movable by force of spring external to said inside vertical wall between a No. 1 position locating toward floor and a No. 2 position locating withdrawn from said No. 1 position opposite to floor, said auxiliary suction wall being positioned toward floor when no external forces are applied, wherein said auxiliary suction wall is formed along periphery thereof with a plurality of catching prominences that are supportable by insertion at the base case, and at both sides thereof with guide rods protruding, wherein said guide rod each is inserted by said spring capable of applying force in such a direction that said auxiliary suction wall should get far from said base case.

2. The robot cleaner according to claim 1, wherein said auxiliary suction wall is further formed at the side thereof touching on floor, with a flange for increasing contact area with floor.

* * * * *